United States Patent [19]

Fend

[11] Patent Number: 4,892,355

[45] Date of Patent: Jan. 9, 1990

[54] CHAIR CONSTRUCTION

[75] Inventor: Fritz M. Fend, Regensburg, Fed. Rep. of Germany

[73] Assignee: Samsonite Furniture Company, Murfreesboro, Tenn.

[21] Appl. No.: 932,448

[22] Filed: Nov. 18, 1986

[30] Foreign Application Priority Data

Mar. 21, 1986 [DE] Fed. Rep. of Germany ..... 3609591

[51] Int. Cl.[4] ..... A47C 7/00

[52] U.S. Cl. ..... 297/440; 297/457

[58] Field of Search ..... 297/440, 452, 457, DIG. 2

[56] References Cited

U.S. PATENT DOCUMENTS

| | | | |
|---|---|---|---|
| 400,296 | 3/1889 | Brott . | |
| 2,999,662 | 9/1961 | Lappin . | |
| 3,061,374 | 10/1962 | Grosfillex . | |
| 3,146,602 | 8/1964 | Grosfillex . | |
| 3,166,030 | 1/1965 | Ludvigsen . | |
| 3,197,165 | 7/1965 | Gits | 297/457 X |
| 3,245,715 | 4/1966 | Gits . | |
| 3,393,941 | 7/1968 | Grosfillex | 297/457 X |
| 3,476,342 | 11/1969 | Motl et al. . | |
| 3,556,076 | 1/1971 | Stewart . | |
| 3,847,331 | 11/1974 | Vallinotto et al. . | |
| 3,904,243 | 9/1975 | Kosteleo et al. . | |
| 3,915,493 | 10/1975 | Brown | 297/452 X |

FOREIGN PATENT DOCUMENTS

| | | | |
|---|---|---|---|
| 2551978 | 5/1976 | Fed. Rep. of Germany | 297/457 |
| 1494770 | 9/1967 | France | 297/DIG. 2 |
| 1505526 | 11/1967 | France . | |
| 939458 | 10/1963 | United Kingdom | 297/440 |
| 1123881 | 8/1968 | United Kingdom . | |

*Primary Examiner*—James R. Brittain

*Attorney, Agent, or Firm*—Steve Rosenblatt; Richard Morgan

[57] ABSTRACT

The apparatus comprises a chair having a frame with a forward and rear transverse supporting members. A seat is mounted to the forward and rear transverse members and further comprises a rear attachment between the seat and the rear transverse supporting member to secure the rear of the seat to the frame. A front attachment member extends from the seat and is adapted to engage the forward transverse supporting member when the rear attachment member engages the rear transverse supporting member. A clip adapted to engage the forward transverse support member secures engagement between the front attachment member and the forward transverse supporting member. The seat is constructed having a peripheral groove which is disposed behind or underneath the seat so as not to be visible when standing in front of the chair. A combination cushion and upholstery covering is applied to the chair with the edges of the upholstery extending to the lowermost point of the peripheral groove whereupon a welt is inserted into the groove to retain the edges of the fabric.

31 Claims, 4 Drawing Sheets

CHAIR CONSTRUCTION

FIELD OF THE INVENTION

The field of the invention relates to chair design.

BACKGROUND OF THE INVENTION

Over the years, numerous different chair designs have been developed. Several such designs have employed a pre-molded seat, with an integral back, attached to a tubular frame. Various was of attaching the tubular frame to the seat were employed. Some designs employed brackets which allowed the seat to be secured to the bracket and at the same time allowed the frame to be secured to the bracket using suitable fasteners such as screws or bolts. Illustrative of such designs are U.S. Pat. Nos. 3,904,243; 3,476,342; 3,166,030; and 2,999,662. Other designs have employed a plurality of split sleeves formed on the undersurface of the seat which were pressed onto a frame member. These split sleeves generally had a U-shaped configuration and were open at their lower end. The sleeve materials were resilient. When the seat was pressed onto the frame member the clip members parted temporarily followed by the clip members springing back to the original position and gripping the frame member. illustrative of such designs are U.S. Pat. Nos. 3,245,715 and 3,146,028. It is noted that in U.S. Pat. No. 3,146,028, the rear engagement between the seat and the fame occurs behind the back of the seat as opposed to the underside of the seat. However, the technique of using flexible engaging elements is still employed. U.S. Pat. No. 3,061,374 employs the identical technique revealed in U.S. Pat. No. 3,146,028. Another design has been to employ a frame involving interlocked and inclined legs which engage a pair of opposed open hooks in order to support a load. This design is shown in the application of a support for a portable barbecue grill as illustrated in U.S. Pat. No. 3,556,076. The legs 50 and 44 are retained in the hook member 66 and are retained in that position by an interference fit with the other side of the grill 86. A combination of a hook element with a resilient U-shaped clamping element to retain a seat to a frame is illustrated in U.S. Pat. No. 3,393,941. The '941 patent illustrates a front hook shaped support member combined with a rear U-shaped gripping member which resiliently flexes over the support bar 1*b* and then engages the support bar as the resilient members 2*d* resume their initial position. Also relevant to the apparatus of the present invention is U.S. Pat. No. 400,296 illustrating a wire clamp wherein a wire 3 is installed through a pair of opposed hook shaped members 2 in such a manner that the installation of one wire over another wire retains the two wires together.

One of the design shortcomings of using resilient U-shaped clip members to resiliently flex over a support member and then spring back to their original shape, is that only a limited amount of gripping force is available to retain the seat to the frame. In the design of the '941 patent, which employs the hook shaped member in the front of the seat and the inverted U-shaped clip member in the back of the seat, the entire back of the seat can be dislodged from the frame if a sufficiently large load is applied to the very front of the seat. Similarly, when such chairs of the design of the '941 patent are being handled in normal use, a significant load applied from the rear of the back rest toward the front of the seat with the frame restrained will also potentially dislodge the connection 2*d* at the rear of the seat.

It is thus desirable to provide an attachment system that is economical to manufacture and has the desirable properties of maintaining a secure engagement between the frame and the seat. Another desirable feature is to provide the above-recited features in combination with an upholstered seat. In using an upholstered seat, it is desirable to secure the edge of the upholstery fabric out of sight of the person viewing the chair. In that manner, the aesthetic features of the chair are accentuated without any distraction from fasteners between the upholstery and the seat. Some designs have applied a visible welt to the periphery of the upholstery to secure the upholstery to the seat. Illustrative of such designs are U.S. Pat. Nos. 4,558,904; 2,151,628; and 3,273,178. Other designs have employed a pronounced peripheral casing around the seat which included a mechanism for attaching the edges of the upholstery to the seat. Illustrative of such design is U.S. Pat. No. 2,551,084. Other designs have employed an elongated profile strip which has its ends specifically designed to engage a recess in the underside of the seat for the purposes of retaining the cushion and upholstery covering to the seat. Illustrative of such design in U.S. Pat. No. 4,408,797. Yet another method of securing the upholstery to the shell is to employ a retaining element having a substantially circular cross-section with an extending finger therefrom. The fabric ends are rolled around the finger and then snapped into a peripheral C-shaped retaining track. Illustrative of such designs are U.S. Pat. Nos. 4,357,723 and 4,465,534. Other designs have employed a recessed groove with a welt cord disposed therein. The welt cord was attached into the groove by means of a staple. Alternatively, an adhesive was used to hold the edge of the fabric to the welt before the welt was fitted into the mounting groove. Illustrative of such design is U.S. Pat. No. 4,370,002.

SUMMARY OF THE INVENTION

The invention comprises a chair having a frame with a forward and rear transverse supporting members. A seat is mounted to the forward and rear transverse members and further comprises a rear attachment between the seat and the rear transverse supporting member to secure the rear of the seat to the frame. A front attachment member extends from the seat and is adapted to engage the forward transverse supporting member when the rear attachment member engages the rear transverse supporting member. A clip adapted to engage the forward transverse support member secures engagement between the front attachment member and the forward transverse supporting member. The seat is constructed having a peripheral groove which is disposed behind or underneath the seat so as not to be visible when standing in front of the chair. A combination cushion and upholstery covering is applied to the chair with the edges of the upholstery extending to the lowermost point of the peripheral groove whereupon a welt is inserted into the groove to retain the edges of the fabric.

DETAILED DESCRIPTION OF THE PREFERRED EMBODIMENT

Figure 1:
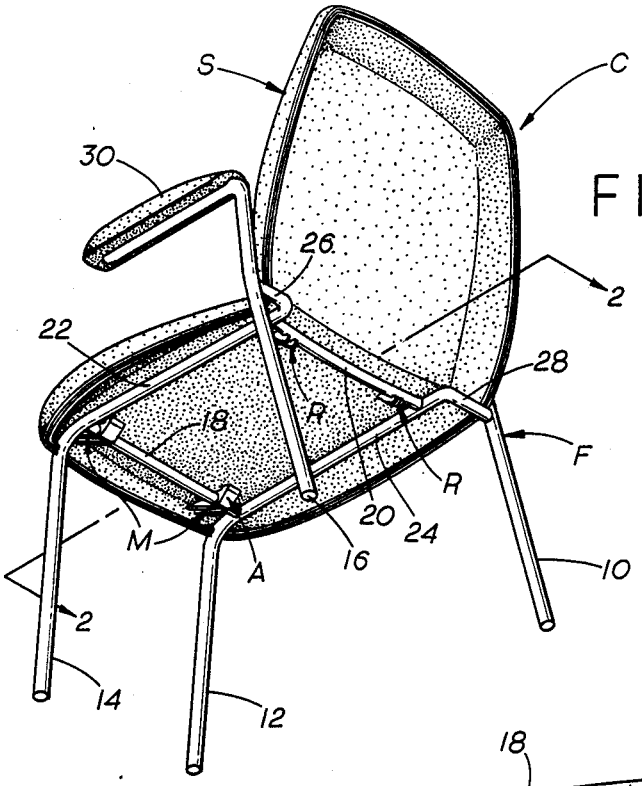
FIG. 1 is an isometric view of the chair looking up at the underside of the seat.
Figure 4:
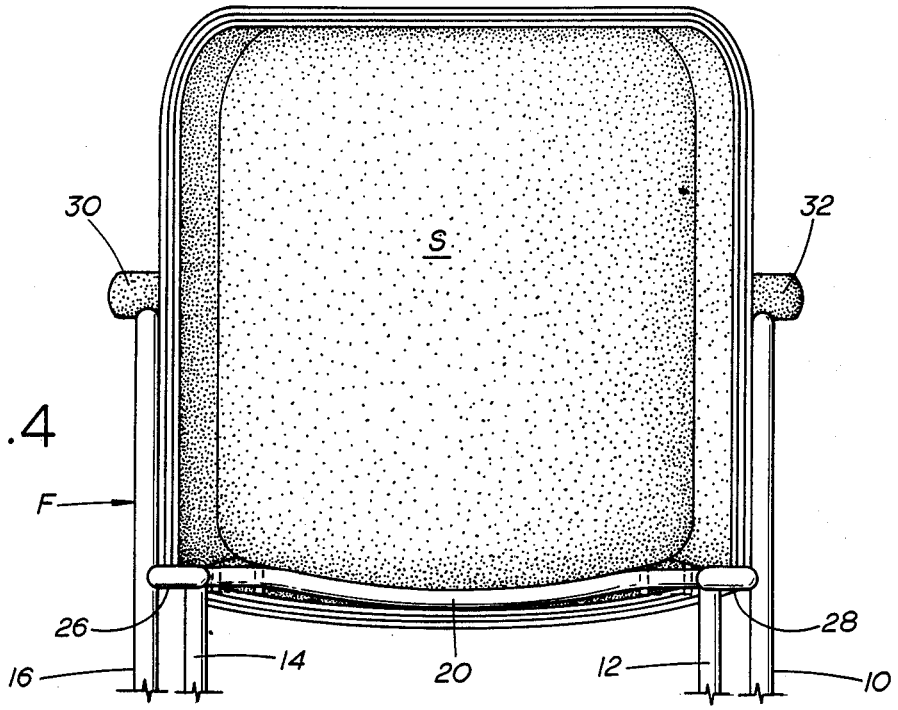
FIG. 4 is a rear elevational view of the backrest of the chair illustrated in FIG. 1.

As seen in the figures the chair C of the present invention includes a seat S and a frame F. Seat S is preferably a molded unitary plastic member. Referring to FIG. 1, frame F has four legs, 10, 12, 14 and 16. These legs are generally vertical and act to support the seat S. Legs 10, 12, 14 and 16 are interconnected by forward transverse supporting member 18 and rear transverse supporting member 20. The frame is completed by members 22 and 24 which are disposed parallel to each other. Forward transverse support member 18 and rear transverse support member 20 are connected on one end to member 22 and on the opposite end to member 24. In versions of the chair C which have arms, as illustrated in FIG. 1, extensions 26 and 28 are provided to members 22 and 24 respectively. As shown in FIG. 1, leg 16 is extended to connect to extension 26 and also serve as a support for arm rest 30. Similarly, as seen in FIG. 4, rear leg 10 is connected to extension 28 and serves as a support member for arm rest 32. Arm rests 30 and 32 can be produced as a premolded plastic member, with or without upholstery, depending upon the desired look and other cost factors.

The frame F is preferably constructed of a light weight high strength metallic material and preferably has a circular cross-section. It is understood that other materials and cross-sections can be used without departing from the spirit of the invention.

Figure 3:
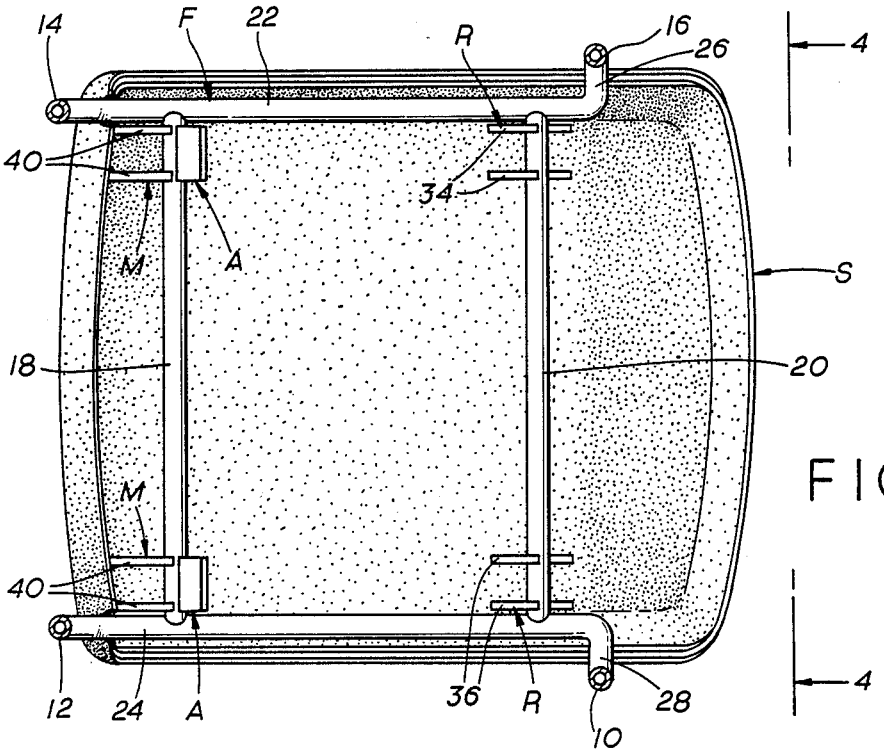
FIG. 3 is a plan view of the underside of the chair as illustrated in FIG. 1.

The seat S is connected to the frame F by virtue of rear attachment means R, front attachment member M and clip A (FIG. 3).

Figure 2:
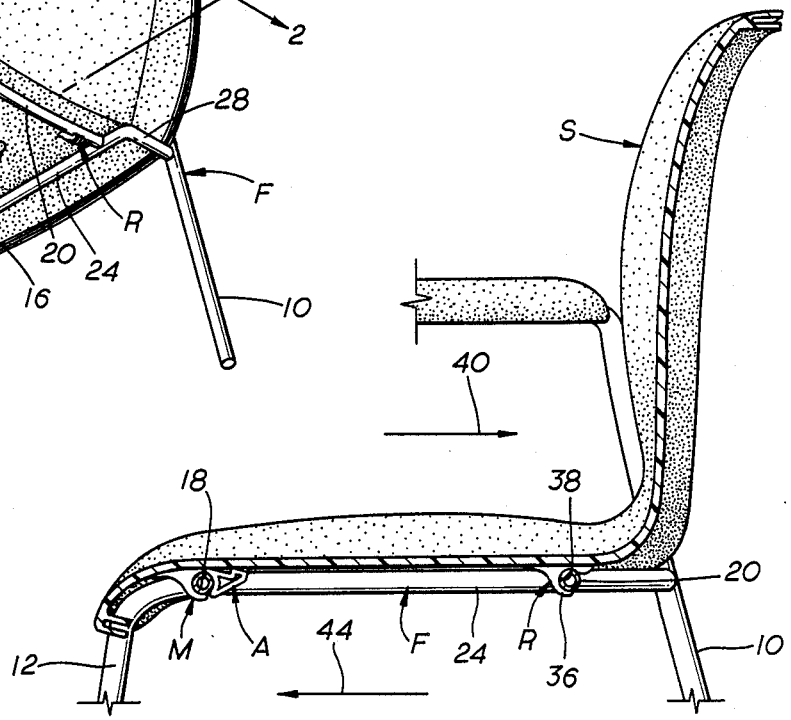
FIG. 2 is a sectional elevation taken along lines 2—2 of FIG. 1.

In the preferred embodiment, rear attachment means R is illustrated in more detail in FIG. 2 and 3. As shown in FIG. 2, rear attachment means R preferably comprises of matched pairs of rigid crescent shaped extension members 34 on one side of the chair and identical crescent shaped extension members 36 on the opposite side of the chair (FIGS. 2 and 3). In the preferred embodiment, members 34 and 36 are included in the mold when the seat S is formed. However, members 34 and 36 can be separately made and subsequently attached to the underside of the seat S. Although members 34 and 36 are shown disposed as matched pairs on the underside of seat S, a sufficiently rigid unitary member, preferably having the shape of members 34 or 36, can be employed without departing from the spirit of the invention.

Referring to FIG. 2, members 34, as well as members 36 which are identical thereto, all have rearwardly facing arcuate surfaces 38 which are contoured for continuous engagement with the outer periphery of rear transverse support member 20. Thus, in securing the seat S to the frame F, the seat S is brought down to bear on the frame with members 34 and 36 disposed between forward transverse support member 18 and rear transverse support member 20. The seat is then pushed in a rearward direction (arrow 40, FIG. 2) until arcuate surfaces 38 on members 34 and 36 are in firm engagement with rear transverse support member 20.

In the preferred embodiment, seat S has been constructed of a premolded plastic material further including a front attachment member M. As seen in FIG. 3, front attachment member M is disposed along the front of seat S such that when arcuate surface 38 of rear attachment means R engages rear transverse support member 20, front attachment member M engages forward transverse support member 18 (FIG. 2). Attachment member M extends out of the underside of seat S in a location adjacent both ends of forward transverse support member 18. Attachment member M may be formed integrally with seat S or may be separately formed for subsequent attachment without departing from the spirit of the invention.

Figure 5:
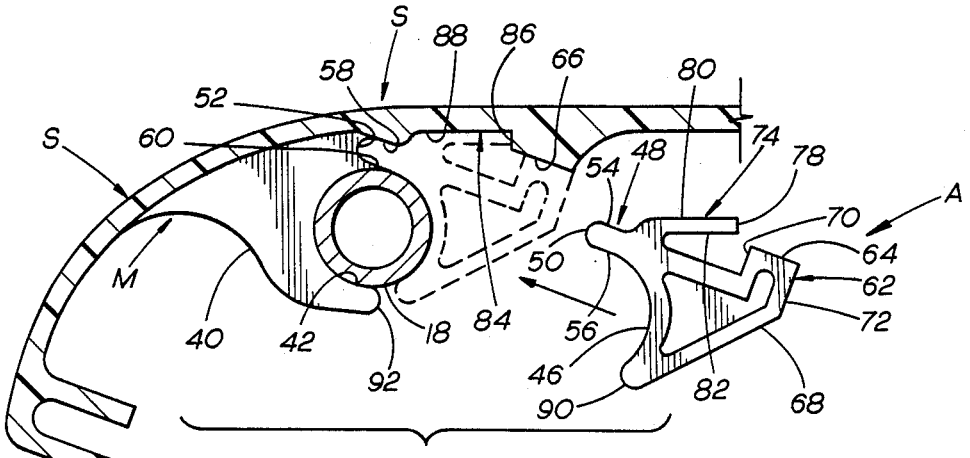
FIG. 5 is a detailed view of the method of attaching the seat to the forward transverse supporting member.

As seen in FIGS. 3 and 5, attachment member M comprises pairs of rigid crescent shaped extensions 40 from the underside of seat S. Crescent shaped extensions 40 each have a rearwardly facing arcuate surface 42 which conforms to the outer periphery of forward transverse support member 18 for continuous engagement therebetween. As shown in FIG. 3, a pair of crescent shaped members 40 are disposed at either rend of forward transverse support member 18. It is understood to be within the purview of the invention, as an alternative to two crescent shaped members 40 in a spaced relationship to each other, to employ one unitary attachment member M, at each end of forward transverse supporting member 18, having the width of the gap shown between the crescent members 40 in Fig. 3. Alternatively, an attachment member M which extends the length of front transverse support member 18 can be used.

When assembling the seat S to the frame F, rearwardly facing arcuate surfaces 42 of each member 40 engage forward transverse support member 18 as rearwardly facing arcuate surfaces 38 engage rear transverse support member 20. It is understood to be within the purview of the invention to have arcuate surfaces 38 and 42 both forward facing (arrow 44, FIG. 2), however, it is preferred to have arcuate surfaces 38 and 42 both facing in the same direction and rearwardly (arrow 40 FIG. 2).

To complete the attachment of seat to frame f, clip A is inserted to interact with seat S and forward transverse support member 18. It is understood that it is within the purview of the invention to apply clip A to interact with seat S adjacent rear transverse support member 20 only, or both at the forward 18 and rear 20 transverse members. Alternatively, the seats can be secured to members 22 and 24 in the same variety of ways described above. However, it is preferred to have the clip disposed solely adjacent forward transverse support member 18.

Figure 6:
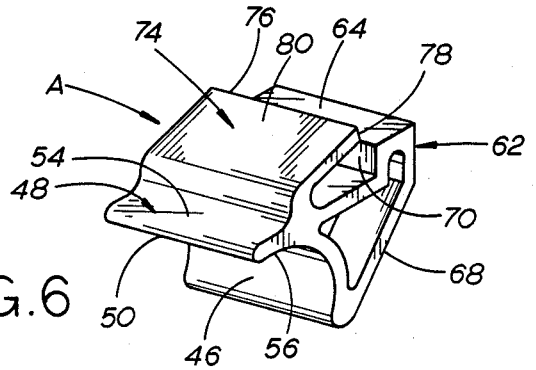
FIG. 6 is an isometric view of the clip designed to cooperate with the forward transverse supporting member to retain the front end of the seat to the frame.

The details of clip A are shown in FIGS. 5 and 6. Clip A is constructed preferably from a light weight high strength material such as a rigid plastic. Other materials may be used without departing from the spirit of the invention. Clip A includes an arcuate surface 46 which as shown in FIG. 5 is forward facing and adapted to the contour of forward transverse support member 18 for continuous engagement therebetween. Arcuate surface 46 blends into a projection 48 extending from clip A. Projection 48 has an arcuate end surface which is designed to conform to the arcuate depression 52 disposed adjacent crescent shaped projections 40. Arcuate surface 50 is disposed between substantially straight surfaces 54 and 56. Surfaces 54 and 56 engage surfaces 58 and 60, respectively when the clip A is installed. Surface 60 is preferably disposed on crescent shaped member 40 while surface 58 preferably comprises the underside of a portion of the seat S.

Another projection 62 contains a bearing surface 64. When the clip A is installed, bearing surface 64 engages surface 66 premolded on the underside of seat S. Thus, when clip A is installed there is preferably flush continuous contact between surfaces 64 and 66. Surface 64, acting in part through edge 68 of clip A, transfers loads applied to seat S through edge 68 onto forward transverse support member 18. Projection 62 extends beyond surface 54 and comprises of surfaces 70, 64 and 72. Surfaces 70 and 72 are parallel to each other and surface 64 is perpendicular to surfaces 70 and 72. Surface 70 extends perpendicularly from surface 54 at one end thereof. Edge 68 extends angularly from surface 72 toward lower end 90 of clip A.

Another projection 74 extends from surface 54 from a point between projection 48 and projection 62.

Projection 74 is rearwardly inclined from surface 54 to its free end 76 (FIG. 6). End 76 has a substantially planar engagement surface 78 thereon. Thus, projection 74 is defined by top surface 80, engagement surface 78, and bottom surface 82. As seen in FIG. 5, engagement surface 78 extends further from surface 54 than bearing surface 64. Projection 74 is designed for inward deflection toward surface 54 during the installation procedure for clip A as will be described hereinbelow.

Seat S is formed having a depression 84 thereon. "Depression" is used in the relative context to emphasize that bottom surface 88 does not project from seat S as far as surface 66. To avoid an overly thin seat S, the entire area around bottom surface 88 and surface 66 can be built up as shown in FIG. 5. Depression 84 has a longitudinal axis substantially parallel to forward transverse support member 18 and is preferably disposed rearwardly thereof. As seen in FIG. 5, when clip A is assembled to seat S and forward transverse support member 18, projection 74 extends into depression 84. Depression 84 further includes contact surface 86 and a substantially planar bottom surface 88 disposed adjacent and perpendicularly thereto. As seen in FIG. 5, when clip A is installed, the final position of projection 74 has engagement surface 78 butted flush up against contact surface 86 and top surface 80 in contact with bottom surface 88 of depression 84.

The installation process of clip A requires the initial placement of clip A adjacent forward transverse support member 18. Initially, projection 74 will be somewhat deflected toward surface 54 from its neutral position. Simultaneously, arcuate end surface 50 will be oriented in the direction of depression 52 on crescent shaped members 40. Subsequently, suitable pressure or blows applied to surface 72 result in advancement of clip A, whereupon projection 74 clears surface 66 and springs into depression 84. The spring forces built up as a result of the initial deflection of projection 74 toward surface 54 are employed in forcing projection 74 into depression 84. There results a preferably force fit between contact surface 86 and engagement surface 78 thus retaining projection 74 within depression 84. Simultaneous with the engagement of contact surface 86 with engagement surface 78, arcuate end surface 50 of clip A engages the base of the arcuate depression 52 within crescent members 40. The interference fit between surfaces 78 and 86 forces arcuate end surface 50 into tight contact with arcuate depression 52 and forces a tight contact between arcuate surface 46 and forward transverse support member 18. It should be noted that during the installation process, bearing surface 64 has been translating with respect to its mating surface 66 on seat S. The final position of clip A is illustrated in dashed lines in FIG. 5.

Figure 9:
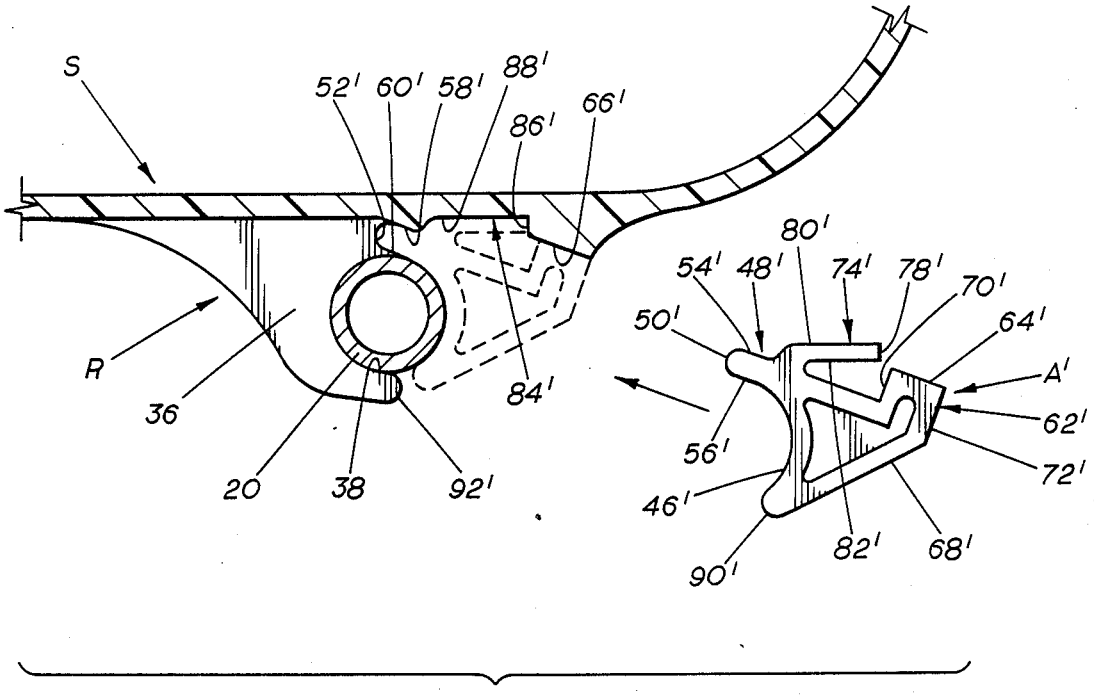
FIG. 9 is a detailed view of attachment of the seat to the rear transverse support member.

Similarly shown in FIG. 9 is the attachment of the seat S to the rear transverse support member 20. Attachment member R comprises pairs of rigid crescent-shaped extensions 36 from the underside of seat S. Crescent-shaped extensions 36 each have a rearwardly facing arcuate surface 38, which conforms to the outer periphery of rear transverse support member 20. Clip A′ is inserted to interact with seat S and rear transverse support member 20. The installation of clip A′ requires the initial placement of clip A′ adjacent rear transverse support member 20. The installation is otherwise similar to the installation adjacent forward transverse support member 18, as shown in FIGS. 3 and 5. In this regard, clip A′ corresponds identically with clip A. Likewise, the corresponding members are the same, as follows: 46′ corresponds identically with 46, 56′ with 56, 50′ with 50, 54′ with 54, 48′ with 48, 80′ with 80, 74′ with 74, 78′ with 78, 82′ with 82, 70′ with 70, 64′ with 64, 62′ with 62, 72′ with 72, 68′ with 68, and 90′ with 90. The members of rear attachment member R correspond substantially with those of front attachment M as follows: 92′ corresponds with 92, 60′ with 60, and 52′ with 52. The surfaces on seat S also correspond back to front with 58′ corresponding with 58, 88′ with 88, 86′ with 86, and 66′ with 66.

As shown in FIG. 3, a pair of clips A are installed adjacent either end of forward transverse support member 18 between a pair of crescent shaped members 40. FIG. 3 also shows that clips A are disposed at either end of forward transverse member 18 opposite a pair of crescent shaped extensions 40 on the underside of seat S. In the preferred embodiment, the interference fit between contact surface 86 and engagement surface 78 serves to prevent axial translation of clips A with respect to the longitudinal axis of forward transverse support member 18. Alternative means can also be employed to restrain axial movement of clip A relative to the longitudinal axis of forward transverse support member 18. For example, the width of clip A can be slightly less than the spacing between crescent shaped members 40. Arcuate depression 52 (FIG. 5), rather than going completely through each crescent shaped member 40 can extend only partway through whereupon the wall structure of crescent shaped members 40 adjacent the arcuate depressions 52 can act as a lateral travel stop to clip A. Alternatively, some interaction can be provided between the lower end 90 of clip A and the lower extension 92 of arcuate surface 42 disposed on crescent shaped extension 40. Finally, surface 66 can be provided with a pair of perpendicular wing walls at either end (not shown) to restrain clip A.

Figure 7:
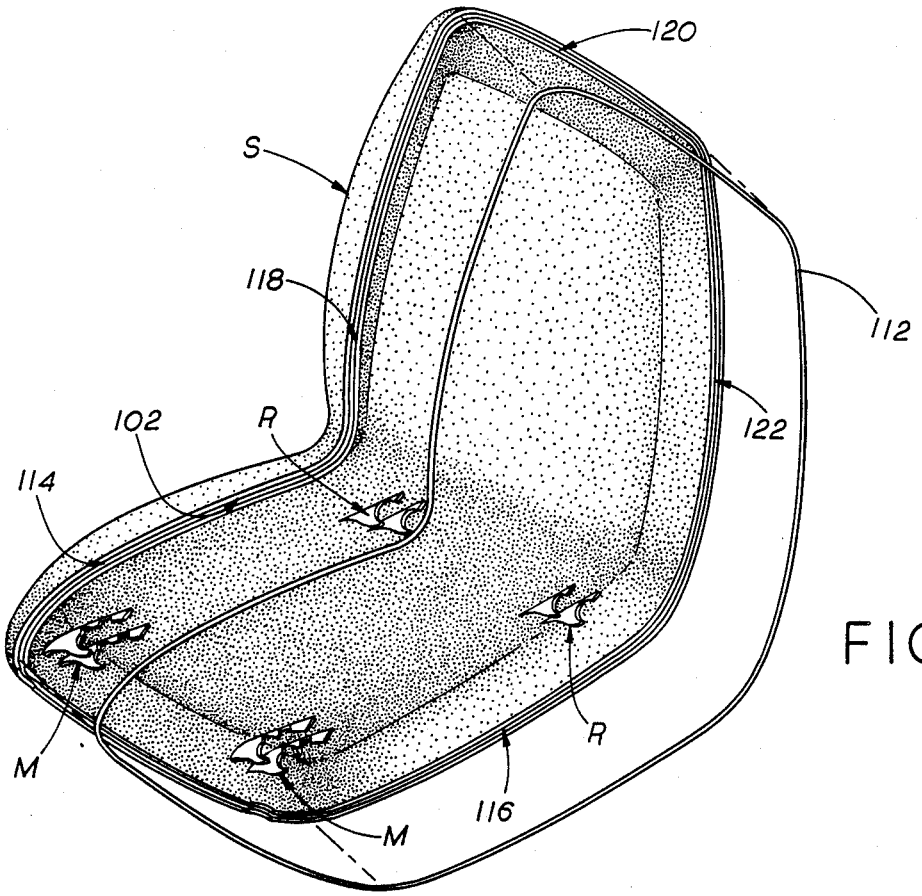
FIG. 7 is an isometric view of the rear of the seat illustrating the peripheral groove therein and the welt adapted to be inserted in such groove.
Figure 8:
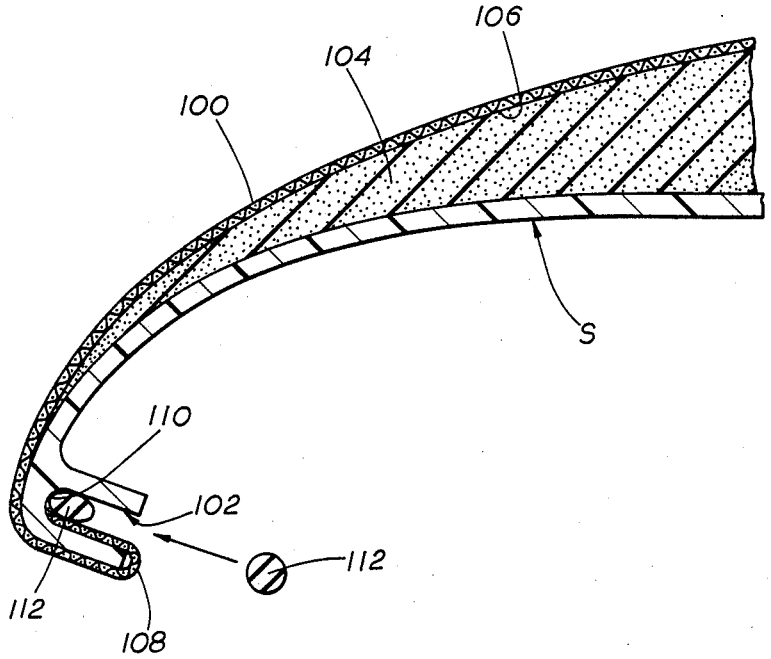
FIG. 8 is an enlarged view of the edge of the seat as illustrated in FIG. 5 showing the application of the cushion and the upholstery covering and the attachment of the upholstery in the peripheral groove.

Another aspect of the present invention is the method of attaching the upholstery 100 (FIG. 8) to the seat S. The underside of seat S has a continuous groove 102 as illustrated in FIG. 7. Upholstery 100, preferably having a flame bonded backing, is stretched onto a mold (not shown). A cushion 104 of polyurethane foam is foamed directly onto the back surface 106 of the upholstery 100. Preferably, the upholstery 100 and cushion 104 combination is positioned on the upper surface of the seat S. The upholstery-cushion combination is pressed onto the seat S thereby providing extra amount of fabric 108 which projects beyond the edges of the seat S. The fabric is pulled around and into continuous groove 102. As shown in FIG. 8, the fabric terminates at the lowermost point 110 within continuous groove 102. A continuous resilient member 112, preferably rubber having a round cross-section, is inserted into groove 102 and retains the end 108 of upholstery 100 to the lowermost point of groove 102. The mounting force previously applied to the cushion and upholstery is withdrawn, as a result a taut, smooth fabric 100 wraps around the seat S. Groove 102 is rearwardly facing near the front of the chair so as to hide its existence to one viewing the upholstered seat while standing next to the chair. The groove 102 is downwardly facing along sections 114 and 116 and rearwardly facing along sections 118, 120 and 122.

The foregoing disclosure and description of the invention are illustrative and explanatory thereof, and various changes in the size, shape and materials, as well as in the details of the illustrated construction may be made without departing from the spirit of the invention.

I claim:

1. A chair comprising:

a frame having a forward and a rear transverse supporting member;

a seat mounted to said forward and rear transverse supporting members, said seat further comprising:

rigid rear seat attachment means,for unflexingly engaging said rear transverse supporting member to selectively secure the rear of said seat to said frame;

a front attachment member extending from said seat and adapted to engage said forward transverse supporting member when said rear attachment means engages said rear transverse supporting member;

a clip, said clip having a rigid body, a first projection and a second, bearing surface projection, said clip adapted to engage said forward transverse supporting member whereupon said clip is retained to said forward transverse supporting member by virtue of said projections: said first projection positioned between said forward transverse supporting member and said seat and said bearing surface projection laterally spaced from said first projection and engaged with said seat at a bearing surface to provide a moment about said first projection with a force applied to said bearing surface thereby transferring load placed on said seat to said forward transverse supporting member, said clip securing said engagement between said front attachment member and said forward transverse supporting member.

2. The chair of claim 1 wherein said clip also engages said front attachment member.

3. The chair of claim 2 wherein:

said front attachment member is formed having a depression thereon;

said first projection adapted to be inserted into said depression on said front attachment member;

whereupon when said clip is mounted, said transverse supporting member is substantially circumscribed by said front attachment member and said clip.

4. The chair of claim 3 wherein:

said forward transverse supporting member has a round cross-section;

said front attachment member has an arcuate surface adapted to engage a portion of the periphery of said forward supporting member;

said clip has an arcuate surface adapted to engage a portion of the periphery of said forward transverse supporting member.

5. The chair of claim 4 wherein:

said clip further comprising a third projection laterally spaced from said first projection on said clip, extending from said clip and having a free end, said third projection inclined away from said first projection;

said third projection extending into an elongated depression in said seat to secure the position of said clip in contact with said seat, said front attachment member and said forward transverse supporting member.

6. The chair of claim 5 wherein:

said depression has a substantially planar contact surface and a substantially planar bottom surface disposed adjacent thereto;

said third projection on said clip further comprises a substantially planar engagement surface at its free end;

whereupon when said first projection of said clip engages said depression in said front attachment member, and further insertion pressure is applied to said clip, said third projection on said clip, having initially been deflected toward opposed alignment with said first projection, resiliently springs into said depression in said seat, resulting in substantial alignment between said engagement surface of said third projection and said contact surface in said depression in said seat, in a transitional fit.

7. The chair of claim 6 wherein said engagement surface of said third projection and said contact surface in said depression of said seat are in contact in an interference fit;

said bottom surface in said depression in said seat is substantially perpendicular to said contact surface;

said third projection also engages said bottom surface in said depression in said seat.

8. The chair of claim 7 wherein said second projection is disposed in a spaced relation to said first projection, with said third projection therebetween.

9. The chair of claim 8 wherein:

said second projection further comprises a mounting surface substantially conforming to the outline of said seat adjacent its point of contact, to facilitate a flush engagement between said mounting surface and said seat.

10. The chair of claim 9 wherein:

said front attachment member is substantially crescent shaped and disposed forward of said forward transverse supporting member;

said depression in said seat is disposed rearwardly of said forward transverse supporting member;

said contact surface in said depresson in said seat is forward facing;

said engagement surface of said third projection of said clip in contact with said forward facing surface in said depression of said seat.

11. The chair of claim 10 wherein said front attachment member comprises a pair of crescent shaped aligned members disposed in a spaced relation to each other;

said front attachment member further comprising a raised support surface adapted for flush engagement with said mounting surface of said third projection;

said clip insertable substantially between said aligned members;

said front attachment member restraining axial movement of said clip with respect to said forward transverse supporting member.

12. The chair of claim 11 wherein:

said rear attachment means comprises a rearwardly facing hook shaped member engaging said rear transverse supporting member.

13. The chair of claim 12 wherein:

said rear transverse supporting member is circular in cross-section;

said rearwardly facing hook shaped member having an arcuate surface in contact with said rear transverse supporting member.

14. The chair of claim 13 wherein:

rearwardly facing hook shaped member extend from said seat in pairs, with one pair disposed adjacent one end of said rear transverse supporting member and another pair adjacent the opposite end of said rear transverse supporting member.

15. A chair comprising:

a frame having a forward and a rear transverse supporting member;

a seat mounted to said forward and rear transverse supporting members, said seat further comprising:

rear seat attachment means, for engaging said rear transverse supporting member to selectively secure the rear of said seat to said frame;

a front attachment member extending from said seat and adapted to engage said forward transverse supporting member when said rear attachment means engages said rear transverse supporting member;

a clip, said clip adapted to engage said forward transverse supporting member and said seat to secure said engagement between said front attachment member and said forward transverse supporting member;

said clip also engages said front attachment member;

said front attachment member is formed having a depression thereon;

said clip further comprising a first projection thereon, said first projection adapted to be inserted into said depression on said front attachment member;

whereupon when said clip is mounted, said transverse supporting member is substantially circumscribed by said front attachment member and said clip;

said forward transverse supporting member has a round cross-section;

said front attachment member has an arcuate surface adapted to engage a portion of the periphery of said forward transverse supporting member;

said clip has an arcuate surface adapted to engage a portion of the periphery of said forward transverse supporting member;

said seat is formed having an elongated depression thereon said depression having a longitudinal axis substantially parallel to said forward transverse supporting member;

said clip further comprises a second projection extending from said clip from adjacent said first projection and having a free end, said second projection inclined away from said first projection;

said second projection extending into said elongated depression to secure the position of said clip in contact with said seat, said front attachment member and said forward transverse supporting member;

said depression in said seat has a substantially planar contact surface and a substantially planar bottom surface disposed adjacent thereto;

said second projection on said clip further comprises a substantially planar engagement surface at its free end;

whereupon when said first projection of said clip engages said depression in said front attachment member, and further insertion pressure is applied to said clip, said second projection on said clip, having initially been deflected toward opposed alignment with said first projection, resiliently springs into said depression in said seat, resulting in substantial alignment between said engagement surface of said second projection and said contact surface in said depression in said seat, in a transitional fit;

said engagement surface of said second projection and said contact surface in depression of said seat are in contact in an interference fit;

said bottom surface in said depression in said seat is substantially perpendicular to said contact surface;

said second projection also engages said bottom surface in said depression in said seat;

said clip further comprises a third projection disposed in a spaced relation to said first projection, with said second projection therebetween, said third projection adapted to engage said seat when said clip is mounted, to transfer a load placed on the seat to said forward transverse supporting member.

16. A chair comprising:

a frame having a forward and a rear transverse supporting member;

a seat mounted to said forward and rear transverse supporting members, said seat further comprising;

rigid rear seat attachment means, for unflexingly engaging said rear transverse supporting member to selectively secure the rear of said seat to said frame;

a front attachment member extending from said seat and adapted to engage said forward transverse supporting member when said rear attachment means engages said rear transverse supporting member;

a clip, said clip having a rigid body and a first projection and a second transitional fit projection, said clip adapted to engage said forward transverse supporting member whereupon said clip is retained to said forward transverse supporting member by virtue of said projections: (1) said first projection positioned between said forward transverse supporting member and said seat and (2) said second projection laterally spaced from said first projection and in transitional fit with said seat, said clip securing said engagement between said front attachment member and said forward transverse supporting member.

17. The chair of claim 16 wherein said clip also engages said front attachment member.

18. The chair of claim 17 wherein:

said front attachment member is formed having a depression thereon;

said first projection adapted to be inserted into said depression on said front attachment member and said clip.

19. The chair of claim 18 wherein:

said forward transverse supporting member has a round cross-section;

said front attachment member has an arcuate surface adapted to engage a portion of the periphery of said forward supporting member;

said clip has an arcuate surface adapted to engage a portion of the periphery of said forward transverse supporting member.

20. The chair of claim 19 wherein:

said seat is formed having an elongated depression thereon said depression having a longitudinal axis substantially parallel to said forward transverse supporting member;

said second projection, having a free end inclined away from said first projection;

said second projection extending into said elongated depression to secure the position of said clip in contact with said seat, said front attachment member and said forward transverse supporting member.

21. The chair of claim 20 wherein:

said elongated depression has a substantially planar contact surface and a substantially planar bottom surface disposed adjacent thereto;

said second projection on said clip further comprises a substantially planar engagement surface at its free end;

whereupon when said first projection of said clip engages said depression in said front attachment member, and further insertion pressure is applied to said clip, said second projection, resiliently springs into said depression in said seat, resulting in substantial alignment between said engagement surface of said second projection and said contact surface in said depression in said seat, in a transitional fit.

22. The chair of claim 21 wherein said engagement surface of said second projection and said contact surface in said depression of said seat are in contact in an interference fit;

said bottom surface in said depression in said seat is substantially perpendicular to said contact surface;

said second projection also engages said bottom surface in said depression in said seat.

23. The chair of claim 22 wherein said clip further comprises:

a third projection disposed in a spaced relation to said first projection, with said second projection therebetween, said third projection adapted to engage said seat when said clip is mounted, to transfer a load placed on the seat to said forward transverse supporting member.

24. The chair of claim 23 wherein:

said third projection further comprises a mounting surface substantially conforming to the outline of said seat adjacent its point of contact, to facilitate a flush engagement between said mounting surface and said seat.

25. The chair of claim 24 wherein:

said front attachment member is substantially crescent shaped and disposed forward of said forward transverse supporting member;

said depression in said seat is disposed rearwardly of said forward transverse supporting member;

said contact surface in said depression in said seat is forward facing;

said engagement surface of said second projection of said clip in contact with said forward facing surface in said depression of said seat.

26. The chair of claim 25 wherein said front attachment member comprises a pair of crescent shaped aligned members disposed in a spaced relation to each other;

said front attachment member further comprising a raised support surface adapted for flush engagement with said mounting surface of said third projection;

said clip insertable substantially between said aligned members;

said front attachment member restraining axial movement of said clip with respect to said forward transverse supporting member.

27. The chair of claim 26 wherein:

said rear attachment means comprises a rearwardly facing hook shaped member engaging said rear transverse supporting member.

28. The chair of claim 27 wherein;

said rear transverse supporting member is circular in cross-section;

said rearwardly facing hook shaped member having an arcuate surface in contact with said rear transverse supporting member.

29. The chair of claim 28 wherein:

rearwardly facing hook shaped member extend from said seat in pairs, within pair disposed adjacent one end of said rear transverse supporting member and another pair adjacent the opposite end of said rear transverse supporting member.

30. A chair comprising:

a frame having a forward and a rear transverse supporting member;

a seat mounted to said forward and rear transverse supporting members, said seat further comprising:

rigid forward seat attachment means, for unflexingly engaging said forward transverse supporting member to selectively secure the forward portion of said seat to said frame;

a rear attachment member extending from said seat and adapted to engage said rear transverse supporting member when said forward seat attachment means engages said forward transverse supporting member;

a clip, said clip having a rigid body, a first projection and a second, bearing surface projection said clip adapted to engage said rear transverse supporting member whereupon said clip is retained to said rear transverse supporting member by virtue of said projections: said first projection positioned between said rear transverse supporting member and said seat and said bearing surface projection laterally spaced from said first projection and engaged with said seat at a bearing surface to provide a moment about said first projection with a force applied to said bearing surface thereby transferring load placed on said seat to said rear transverse supporting member, said clip securing said engagement between said rear attachment member and said rear transverse supporting member.

31. A chair comprising:

a frame having a forward and a rear transverse supporting member;

a seat mounted to said forward and rear transverse supporting members, said seat further comprising;

rigid forward seat attachment means, for unflexingly engaging said forward transverse supporting member to selectively secure the forward portion of said seat to said frame;

a rear attachment member extending from said seat and adapted to engage said rear transverse supporting member when said forward seat attachment means engages said forward transverse supporting member;

a clip, said clip having a rigid body and a first projection and a second transitional fit, said clip adapted to engage said rear transverse supporting member whereupon said clip is retained to said rear transverse supporting member by virtue of said projections: (1) said first projection positioned between said rear transverse supporting member and said seat and (2) said second projection laterally spaced from said first projection and in transitional fit with said seat;

said clip securing said engagement between said rear attachment member and said rear transverse supporting member.

* * * * *